United States Patent [19]

Leonard et al.

[11] Patent Number: 4,932,847

[45] **Date of Patent: * Jun. 12, 1990**

[54] APPARATUS FOR TRANSMITTING PRESSURE FROM A HYDRAULIC FLUID TO A MATERIAL HAVING SOLID PARTICLES SUSPENDED IN A LIQUID MEDIUM

[75] Inventors: Gary L. Leonard, Colonie; Francis P. Bundy, Alplaus, both of N.Y.

[73] Assignee: General Electric Company, Schenectady, N.Y.

[ * ] Notice: The portion of the term of this patent subsequent to Nov. 1, 2005 has been disclaimed.

[21] Appl. No.: 288,847

[22] Filed: Dec. 23, 1988

[51] Int. Cl.[5] ..... F04B 35/00

[52] U.S. Cl. ..... 417/392; 417/900

[58] Field of Search ..... 417/392, 395, 900; 91/25

[56] References Cited

U.S. PATENT DOCUMENTS

| | | | |
|---|---|---|---|
| 3,306,216 | 2/1967 | Warman | 417/92 |
| 3,938,912 | 2/1976 | Sakamoto et al. | 417/339 |
| 4,187,173 | 2/1980 | Keefer | 210/23 |
| 4,205,946 | 6/1980 | Huso | 417/53 |
| 4,536,135 | 8/1985 | Olsen et al. | 417/383 |
| 4,662,315 | 5/1987 | Sommer | 123/23 |
| 4,690,618 | 9/1987 | Akatsu et al. | 417/226 |
| 4,717,317 | 1/1988 | Hofer et al. | 417/392 |

FOREIGN PATENT DOCUMENTS 01823 9/1980 European Pat. Off. .

*Primary Examiner*—Leonard E. Smith
*Assistant Examiner*—Robert N. Blackmon
*Attorney, Agent, or Firm*—William H. Steinberg; James C. Davis, Jr.; Paul R. Webb, II

[57] ABSTRACT

Apparatus for transmitting pressure from hydraulic fluid to a slurry material includes a housing having a piston chamber defined therein surrounded by a piston chamber wall. The housing also contains an inlet port and an outlet port, through which ports slurry material enters and leaves the piston chamber. A piston is slidably disposed in the chamber so that sliding movement of the piston produces pressurization of the slurry material and movement thereof through the outlet port. A hydraulic fluid channel is disposed in the housing so that pressurized hydraulic fluid therein produces a force on the piston which causes sliding movement thereof, so as to produce a pressure in the slurry material which is proportional to the pressure in the hydraulic fluid. Preferably, the hydraulic fluid channel is further disposed in the flow communication with the clearance gap between the outer surface of the piston and the corresponding surface of the piston chamber wall, so that at least a portion of the pressurized hydraulic fluid passes through the clearance gap and flushes solid particles therefrom. In a preferred embodiment, the apparatus further includes means for counterbalancing the force produced by the slurry material on the interior surface of the piston chamber wall, with an oppositely directed force on the opposite surface of the piston chamber wall.

5 Claims, 5 Drawing Sheets

APPARATUS FOR TRANSMITTING PRESSURE FROM A HYDRAULIC FLUID TO A MATERIAL HAVING SOLID PARTICLES SUSPENDED IN A LIQUID MEDIUM

CROSS REFERENCE

This application is related to issued Patent No. 4,781,544, assigned to the same assignee as the present invention.

BACKGROUND OF THE INVENTION

This invention relates to pressure transmitting devices. More particularly, it relates to means for transmitting the pressure in a hydraulic fluid to inject slurry fuel into combustion chambers such as, for example, those in internal combustion engines.

It is often desirable to use a pressure transmitting device to produce pressure in, and thereby displace a finite volume of, a slurry material, that is, a material having solid particles suspended in a liquid medium. It is also often desirable to use a mechanism which is responsive to a pressurized hydraulic fluid in order to provide this pressurization and displacement of the slurry material. Furthermore, to prevent contamination of the hydraulic fluid by solid particles from the slurry material, it is desirable to substantially isolate the hydraulic fluid from the slurry material. One application where these characteristics are particularly desirable is in a system for injecting slurry fuels into a combustion chamber.

A number of combustion systems are currently candidates for burning solid fuel particles suspended in a liquid medium. In particular, a slurry of coal and water appears to offer significant potential as a substitute for liquid fossil fuels such as, for example, diesel oil. Many of these candidate combustion systems require that the slurry fuel be metered and injected in a highly controlled manner. The fuel injection system must be capable of rapid and accurate operation, over a range of combustor operating conditions. For example, in a diesel engine, the fuel injection system must exhibit the rapid injector opening and closing times typical of conventional diesel fuel injectors, in order to produce the correct burning characteristics in the engine. Diesel engines also require the fuel injection system to operate at relatively high injection pressures, with the pressure exceeding 3000 pounds per square inch in some applications.

Conventional diesel fuel injection systems typically employ a jerk pump to meter and pressurize the diesel oil, and a high pressure needle valve injector to atomize the diesel oil as it enters the combustion chamber. Such a system provides a number of beneficial characteristics, including rapid operation and accurate control of the amount of fuel injected. However, when this type of system is employed to inject a slurry fuel, the solid particles in the slurry tend to become wedged in the clearance gaps between the adjacent surfaces of the sliding parts of the jerk pump and the injector. What is needed, then, is a way to maintain these clearance gaps free from solid fuel particles.

It is an object of the present invention to provide an apparatus for transmitting pressure from a hydraulic fluid to a material having solid particles suspended in a liquid medium.

It is also an object of the present invention to substantially isolate the hydraulic fluid from the solid particles of the material.

It is a further object of the present invention to provide a pressure transmitting apparatus which may be readily employed in a slurry fuel injection system.

SUMMARY OF THE INVENTION

In accordance with the present invention, apparatus for transmitting pressure from a hydraulic fluid to a material having solid particles suspended in a liquid medium, while substantially isolating the hydraulic fluid from the slurry material, comprises a housing having a piston chamber contained therein, with the piston chamber being surrounded by a piston chamber wall. The housing also contains an inlet port and an outlet port, both disposed in flow communication with the piston chamber, so that the slurry material enters the chamber through the inlet port and leaves the chamber through the outlet port. A piston is slidably disposed in the piston chamber so that sliding movement of the piston produces pressurization of the slurry material and movement of the material out of the piston chamber, through the outlet port. A hydraulic fluid channel is also defined in the housing, and is disposed so that pressurized hydraulic fluid therein produces a force on the piston. This force, in turn, causes sliding movement of the piston, so as to produce a pressure in the slurry material which is proportional to the pressure in the hydraulic fluid. Preferably, the hydraulic fluid channel is further disposed in flow communication with a clearance gap between the outer surface of the piston and the corresponding surface of the piston chamber wall, so that at least a portion of the pressurized hydraulic fluid in the hydraulic fluid channel passes through the clearance gap and flushes solid particles therefrom. The apparatus may also include a check valve disposed in the inlet port so as to direct the slurry material to flow through the inlet port in a direction toward the piston chamber, and a seal located between the piston and the piston chamber wall, which seal is disposed so as to further prevent slurry particles from entering the gap between the piston and the piston chamber wall. In a preferred embodiment, the apparatus of the present invention further comprises means for counterbalancing the force produced by the pressurized slurry material in the piston chamber, on the interior surface of the piston chamber wall, with an oppositely directed force on the opposite surface of the piston chamber wall.

BRIEF DESCRIPTION OF THE DRAWING

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawing, in which:

DETAILED DESCRIPTION OF THE INVENTION

Figure 1:
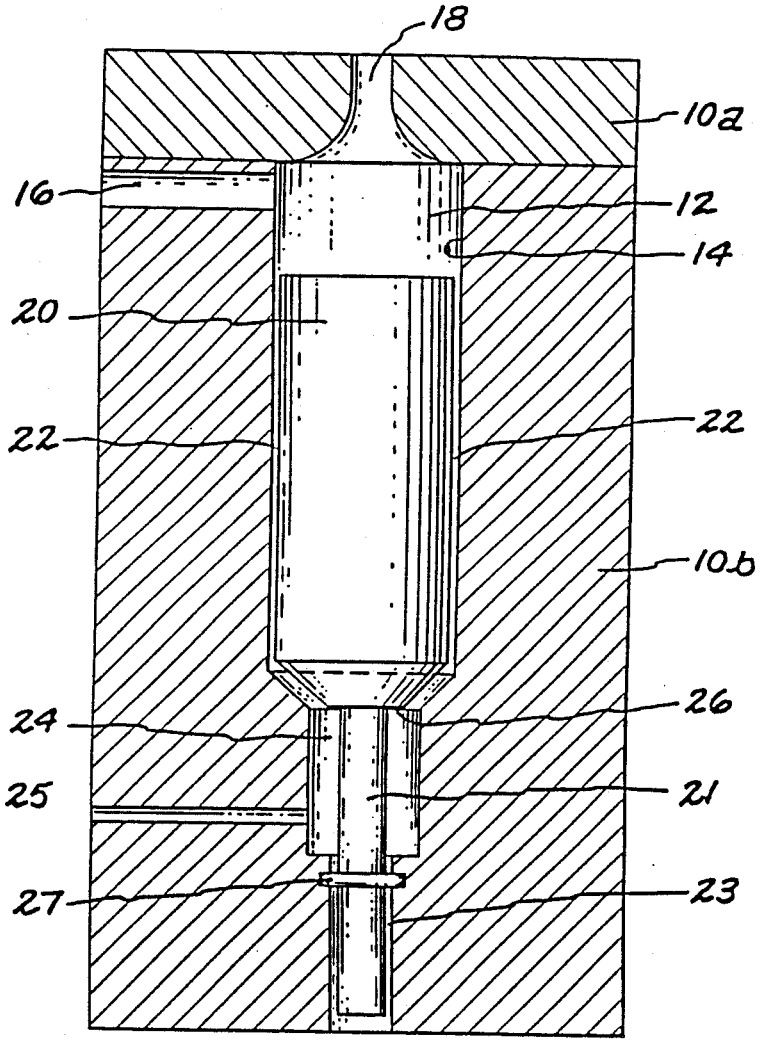
FIG. 1 is a side elevation, cross-sectional view schematically illustrating one embodiment of the present invention.

Referring to the drawing wherein like reference numerals indicate like elements throughout, and more particularly, FIG. 1 thereof, apparatus for transmitting pressure from a hydraulic fluid to a material having solid particles suspended in a liquid medium, while substantially isolating the hydraulic fluid from this material. The apparatus comprises a housing 10 having an upper portion 10*a* and a lower portion 10*b* joined to one another by clamps (not shown). Housing 10 defines a piston chamber 12, which is surrounded by a piston chamber wall 14. Inlet port 16 and outlet port 18 are also defined by housing 10, and are disposed in flow communication with piston chamber 12 so that the slurry material enters chamber 12 through inlet port 16 and leaves chamber 12 through outlet port 18. Piston 20 is slidably disposed in piston chamber 12 so that sliding movement of piston 20 produces pressurization of the slurry material in chamber 12, and movement of the material out of chamber 12 through outlet port 18. Housing 10 also defines a hydraulic fluid channel 24 supplied from a jerk pump (not shown) through a port 25 in flow communication with channel 24. Channel 24 is disposed so that pressurized hydraulic fluid in channel 24 produces a force on surface 26 located on the lower portion of piston 20 adjacent to channel 24. The sliding movement of piston 20 is responsive to the force on surface 26 so as to produce a pressure in the slurry material in piston chamber 12, which pressure is proportional to the pressure in the hydraulic fluid in channel 24. Preferably, piston 20 is further disposed so that the outer surface thereof is separated by clearance gap 22 from the corresponding surface of piston chamber wall 14, and hydraulic fluid channel 24 is further disposed in flow communication with clearance gap 22 so that at least a portion of the pressurized hydraulic fluid in channel 24 passes through clearance gap 22. For a given volume of hydraulic fluid entering channel 24, the size and configuration of channel 24, and the area of surface 26 of piston 20, are chosen so that the pressure in the hydraulic fluid in channel 24 is higher than the pressure in the slurry material in chamber 12. In the embodiment shown in FIG. 1, area-reducing shaft 21 extends from piston 20, and is disposed in channel 24 to reduce the amount of area of surface 26 which is exposed to pressurized fluid in channel 24. Reducing shaft 21 is slidably disposed in aperture 23 of housing 10 so that, as piston 20 moves upward and downward, reducing shaft 21 also moves upward and downward. With shaft 21 being so disposed, it serves its area-reducing function for all positions of piston 20, as piston 20 slides back and forth in piston chamber 12. Hydraulic fluid seal 27 is disposed around reducing shaft 21 in channel 24 so as to prevent hydraulic fluid from passing out of channel 24 through the space between the outer surface of shaft 21 and the surface of housing 10 which defines aperture 23. In the manner illustrated in FIG. 1, a pressure intensification scheme is provided which causes the hydraulic fluid to pass through clearance gap 22, to continuously purge clearance gap 22 with hydraulic fluid and to flush solid particles from the slurry material out of gap 22. If desired, the hydraulic fluid chosen may comprise a lubricating oil, so that piston 20 and piston chamber wall 14 are also lubricated by the fluid passing through clearance gap 22.

Figure 2:
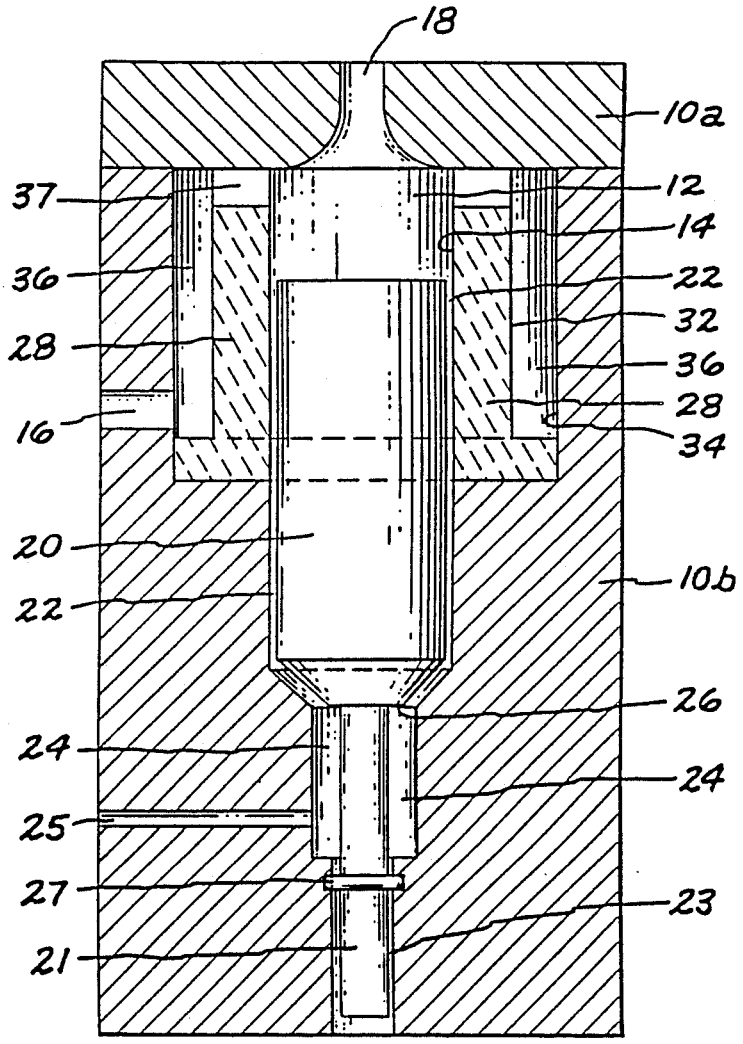
FIG. 2 is a view similar to that of FIG. 1 schematically illustrating one embodiment of means for equalizing the pressure on the piston chamber wall, in accordance with the present invention.

Referring now to FIG. 2, the apparatus of the present invention may further comprise means for counterbalancing the force on the interior surface of piston chamber wall 14 produced by pressurized slurry material in piston chamber 12, with an oppositely directed force on the opposite surface 32 of piston chamber wall 14, produced by directing pressurized material against that opposite surface. The counterbalancing means employed comprises counterbalancing channel 36 disposed adjacent to opposite surface 32 of the piston chamber wall 14. Counterbalancing channel 36 is connected in flow communication with piston chamber 12 through a plurality of passageways 37 so that slurry material entering chamber 12 also enters counterbalancing channel 36, and so that pressure in piston chamber 12 is transmitted to counterbalancing channel 36. Counterbalancing channel 36 is further disposed so that pressurized material therein produces a force on surface 32, which force counterbalances the force produced by pressurized material in piston chamber 12 on piston chamber wall 14. In the particular embodiment shown in FIG. 2, piston chamber 12 is defined by sleeve 28 disposed around piston 20. The inner surface of sleeve 28 is disposed adjacent to the outer surface of piston 20, and is separated therefrom so as to define a portion of clearance gap 22. The outer surface of sleeve 28 is separated from adjacent wall portion 34 of housing 10*b* so as to define counterbalancing channel 36.

Figure 3:
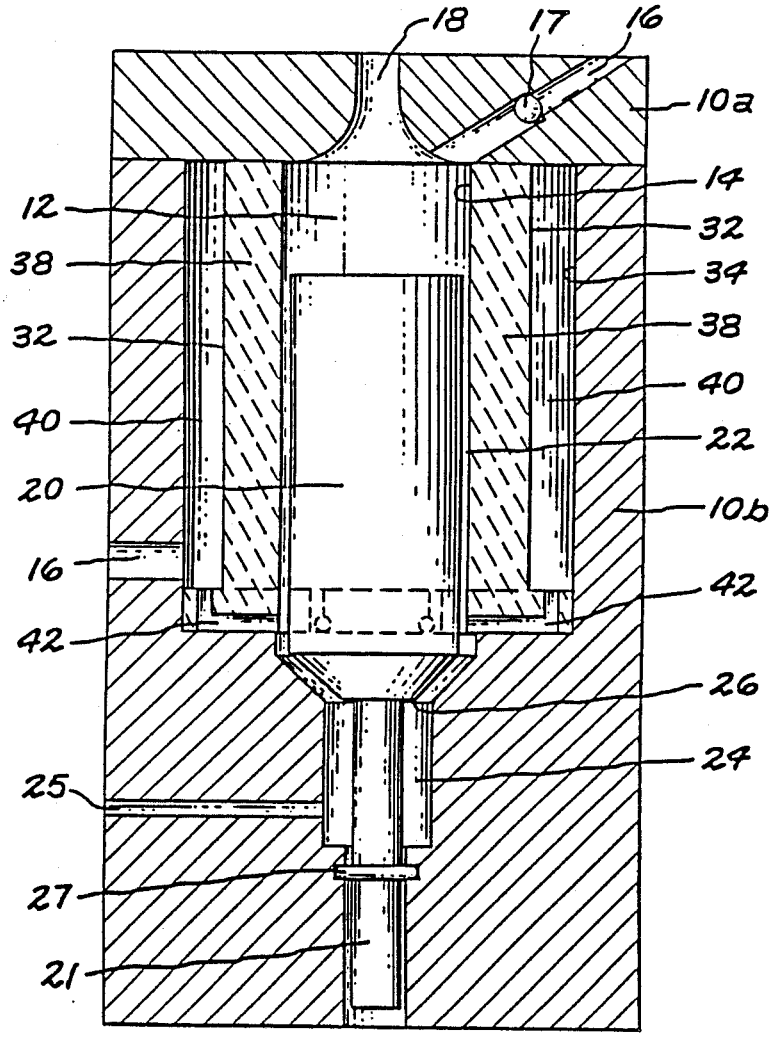
FIG. 3 is a view similar to that of FIG. 2 schematically illustrating an alternative embodiment to the pressure equalizing means shown in FIG. 2, in accordance with the present invention.

In an alternative embodiment to that shown in FIG. 2, which is schematically illustrated in FIG. 3, the counterbalancing means comprises counterbalancing channel 40. Channel 40 is connected in flow communication with hydraulic fluid channel 24 by means of a plurality of hydraulic fluid passages 42, so that hydraulic fluid entering hydraulic fluid channel 24 also enters counterbalancing channel 40, and so that pressure in hydraulic fluid channel 24 is transmitted to counterbalancing channel 40. Counterbalancing channel 40 is further disposed so that pressurized hydraulic fluid therein produces a force on surface 32 which counterbalances the force produced by pressurized material in piston chamber 12 on piston chamber wall 14. As is illustrated in FIG. 3, in one embodiment, counterbalancing channel 40 may be formed by placing sleeve 38 around piston 20, between the outer surface of piston 20 and surface 34 of housing 10.

Providing the apparatus of the present invention with a means for counterbalancing the force on the interior surface of the piston chamber wall by counterbalancing channels 36 and 40, in the manner illustrated in FIGS. 2 and 3, respectively, serves to significantly reduce the net force on the wall 14 which defines the piston chamber in the radially outward direction. Thus, the deflection of the piston chamber wall, as piston 20 travels upwardly and pressurizes the slurry material in piston chamber 12, is minimized. Accordingly, a close fit is provided between the outer surface of piston 20 and the inner surface of the piston chamber wall 14. This close fit, along with the purging action of hydraulic fluid from channel 24 passing through clearance gap 22, keeps solid particles from the slurry material out of the gap between the close fitting, sliding parts of the apparatus. Also, with the mechanical forces between the inner and outer surfaces of the piston chamber wall being more nearly balanced, especially by employing the embodiment shown in FIG. 2, the piston chamber wall may comprise a replaceable very hard, brittle material which does not wear significantly even when slurry particles are present in clearance gap 22. For example, the material employed for the piston chamber wall may comprise such wear-resistant material as silicon carbide.

When the counterbalancing channel is connected in flow communication with piston chamber 12, in the manner illustrated in FIG. 2, the forces on surfaces 14 and 32 are automatically balanced by flow of the slurry material from piston chamber 12 into channel 36. When the counterbalancing channel is connected in flow communication with hydraulic fluid channel 24, in the manner illustrated in FIG. 3, the pressure in counterbalancing channel 40 is greater than the pressure in chamber 12, and thus, the force on surface 32 is greater than the force on surface 14. Accordingly, a net force is produced on sleeve 38 in a radially inwardly direction, which force prevents sleeve 38 from deflecting radially outwardly during sliding movement of piston 20. With the counterbalancing force being provided by pressurized hydraulic fluid, rather than by slurry material from piston chamber 12, inlet port 16 may be disposed so that slurry material enters piston chamber 12 at a location closely adjacent to outlet port 18, in the manner illustrated in FIG. 3. With inlet port 16 so disposed, there is less opportunity for the slurry material to become packed in chamber 12 and for solid slurry particles to become wedged in clearance gap 22.

Figure 4:
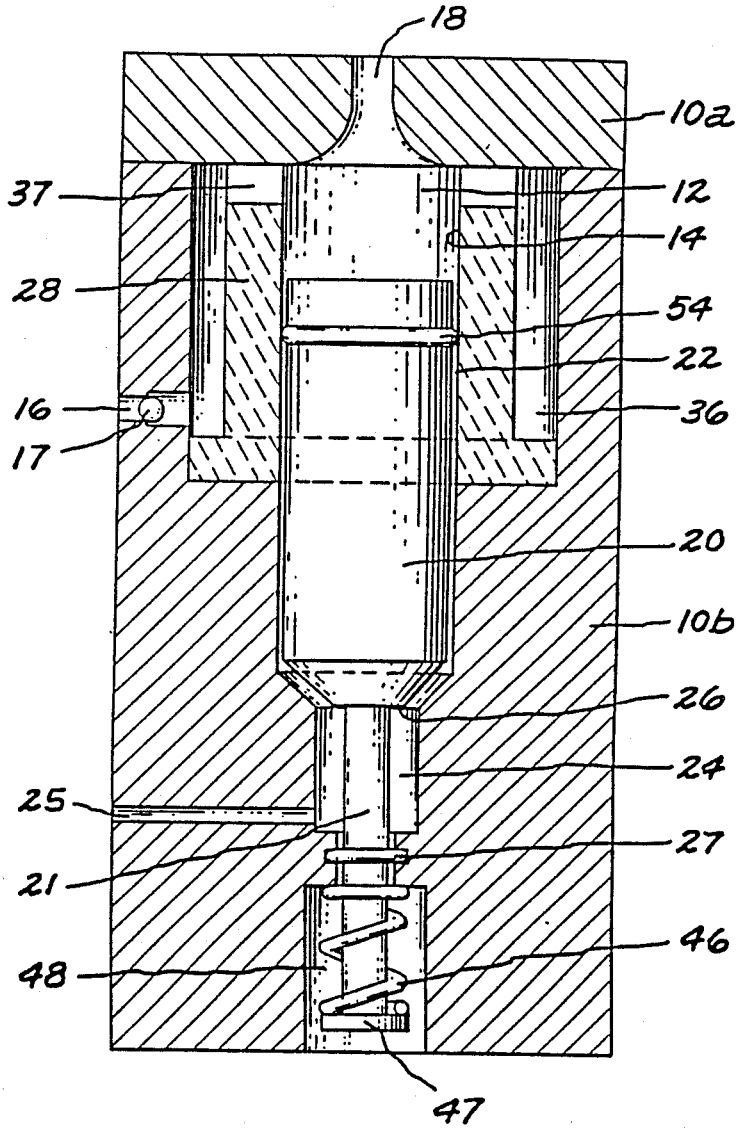
FIG. 4 is a view similar to that of FIG. 1 schematically illustrating yet another embodiment of the present invention.
Figure 5:
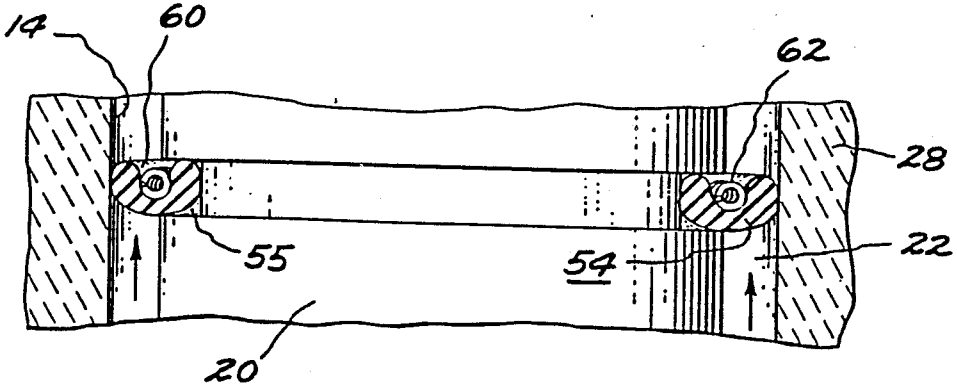
FIG. 5 is an enlarged view of the space between the piston and the piston chamber wall, schematically illustrating one embodiment of a piston seal in accordance with the present invention.

Referring now to FIG. 4, to further prevent solid particles from the slurry material from entering clearance gap 22, the apparatus of the present invention may further comprise a piston seal 54 located between the outer surface of piston 20 and the inner surface of the piston chamber wall. Seal 54 is disposed so that the pressurized hydraulic fluid passing through clearance gap 22 is allowed to pass by seal 54 and into piston chamber 12, and so that the slurry material located in piston chamber 12 is prevented from passing by seal 54 and into clearance gap 22. In one embodiment, schematically illustrated in FIG. 5, this seal comprises a ring of flexible material having a generally U-shaped cross section. A circular spring 62 fits in the U-shaped ring and holds the inner portion of the ring corresponding to one side of the U-shaped cross section, in a circumferential notch 55 in piston 20. The bottom of the U-shaped ring faces away from piston chamber 12. The outer portion of the ring 60, which corresponds with the other side of the U-shaped cross section abuts against piston chamber wall 14. The outer portion of the ring 60 is shaped so that it forms a flexible sealing portion allowing fluid to pass in the direction indicated by the arrows in FIG. 5, from the hydraulic fluid channel 24 through clearance 22 to the piston chamber 12 but not in an opposite direction.

In the embodiment schematically illustrated in FIG. 4, the apparatus of the present invention further comprises means for controlling the sliding movement of piston 20. In the particular embodiment shown, this controlling means comprises spring 46 surrounding the lower portion of area reducing shaft 21 and captured at one end by a flange 47 on the end of shaft 21 and on the other by the upper portion a recess 48 in housing 10. Upward movement of the piston compresses spring 46. The spring is disposed to exert a force on piston 20 in an opposite direction from the force produced on surface 26 of piston 20 by pressurized hydraulic fluid in hydraulic fluid channel 24. Oil pressure seal 27 prevents hydraulic fluid from leaking into reces 48 through the aperture which the area reducing shaft 21 extends.

For all of the embodiments of the present invention discussed above, a check valve 17 may be disposed in inlet port 16 so that the slurry material is allowed to flow through inlet port 16 in a direction toward piston chamber 12, while being prevented from flowing in an opposite direction. Employing check valve 17 in this manner ensures that the pressurized slurry material in chamber 12 is forced out of outlet port 18 when piston 20 moves in an upward direction. The check valve can alternatively be provided in a hydraulic line (not shown) coupled to the port.

In operation, the embodiment of the present invention illustrated in FIG. 4 has slurry fuel entering inlet port 16 through check valve 17 and flowing into piston chamber 12. Pressurized hydraulic fluid enters through port 25 and flows to hydraulic fluid channel 24 and exerts an upward force on surface 26 of piston 20, with the pressure in the hydraulic fluid in channel 24 rapidly rising to a relatively high pressure, for example, a pressure exceeding 10,000 pounds per square inch. The pressurized hydraulic fluid having a pressure about 20% higher than the slurry fuel. This high pressure on surface 26 of piston 20 produces a force which is larger than the oppositely directed force on piston 20 produced by a combination of the force exerted by spring 46 and the force exerted by pressurized slurry fuel in piston chamber 12. Thus, piston 20 moves in an upward direction, and produces further pressurization of the slurry fuel in chamber 12 and movement of the fuel through outlet port 18. The higher pressure of the hydraulic fluid keeps slurry particles away from the sliding parts of the apparatus. As the pressure in the hydraulic fluid in channel 24 decreases to a sufficiently low level that the force exerted on piston 20 by the hydraulic fluid is less than the combined forces exerted on piston 20 by spring 46 and pressurized slurry fuel entering chamber 12 through inlet port 16. Thus, piston 20 moves in a downward direction and returns to its original position.

The foregoing describes an apparatus for transmitting pressure from a hydraulic fluid to a slurry material having solid particles suspended in a liquid medium. The pressure transmitting apparatus of the present invention substantially isolates the hydraulic fluid from the solid particles of the slurry material, and thereby prevents wear and failure caused by solid slurry particles being wedged in the clearance gaps between close fitting, sliding components of the apparatus. Because the apparatus of the present invention prevents contamination of the hydraulic fluid by solid particles from the slurry material, the present invention provides a pressure transmitting apparatus which may be readily employed in a slurry fuel injection system.

While the invention has been described in detail herein in accord with certain preferred embodiments thereof, many modifications and changes therein may be effected by those skilled in the art.

What is claimed is:

1. Apparatus for transmitting pressure from a hydraulic fluid to a slurry fuel, while substantially isolating said hydraulic fluid from said slurry fuel, said apparatus comprising:

a housing including a piston chamber surrounded by a piston chamber wall and an inlet port and an outlet port in flow communication with said piston chamber for allowing said slurry to enter and leave said chamber, respectively;

a check valve disposed in said inlet port so that said slurry fuel is allowed to flow through said inlet port in a direction toward said piston chamber, while being prevented from flowing in an opposite direction;

a piston slidably disposed in said piston chamber so that sliding movement of said piston produces pressurization of said slurry fuel in said piston chamber and movement of said slurry fuel out of said chamber and through said outlet port, with the outer surface of said piston being separated by a clearance gap from the corresponding surface of said piston chamber wall which defines said piston chamber;

said housing defining a hydraulic fluid channel for introducing pressurized hydraulic fluid to produce a force on said piston, with the sliding movement of said piston being responsive to said force so as to produce a pressure in the slurry fuel in said piston chamber, the pressure being proportional to the pressure in said hydraulic fluid, said hydraulic fluid channel being further disposed in flow communication with said clearance gap so that at least a portion of pressurized hydraulic fluid in said channel passes through said clearance gap, so as to flush solid particles from said slurry fuel out of said gap; and means for counterbalancing the force produced by pressurized slurry fuel in said piston chamber, on the interior surface of said piston chamber wall, with an oppositely directed force on the opposite surface of said piston chamber wall, produced by directing pressurized material against said opposite surface.

2. The apparatus of claim 1 wherein said piston includes an area-reducing portion disposed in said hydraulic fluid channel, the surface area of the portion of said piston on which said pressurized hydraulic fluid acts to produce said sliding movement of said piston, being less than the surface area of the portion of said piston which acts to produce pressurization of said slurry material in said piston chamber, so that the resulting pressure in said hydraulic fluid is higher than the resulting pressure in said slurry material.

3. The apparatus of claim 2 wherein said counterbalancing means comprises a counterbalancing channel disposed adjacent to said opposite surface of said piston chamber wall, with said counterbalancing channel being connected in flow communication with said piston chamber so that slurry fuel entering said chamber also enters said counterbalancing channel, and so that pressure in said piston chamber is transmitted to said counterbalancing channel, said counterbalancing channel being further disposed so that said pressurized slurry fuel therein produces a force on said opposite surface of said piston chamber wall which counterbalances the force on the interior surface of said piston chamber wall, produced by said pressurized slurry fuel in said piston chamber.

4. The apparatus of claim 2 wherein said counterbalancing means comprises a counterbalancing channel disposed adjacent to said opposite surface of said piston chamber wall, with said counterbalancing channel being connected in flow communication with said hydraulic fluid channel so that hydraulic fluid entering said hydraulic fluid channel also enters said counterbalancing channel, and so that pressure in said hydraulic fluid channel is transmitted to said counterbalancing channel, said counterbalancing channel being further disposed so that said pressurized hydraulic fluid therein produces a force on said opposite surface of said piston chamber wall which counterbalances the force on the interior surface of said piston chamber wall, produced by said pressurized slurry fuel in said piston chamber.

5. The apparatus of claim 2 further comprising a seal located between said piston and said piston chamber wall, said seal being disposed so that pressurized hydraulic fluid passing through said clearance gap is allowed to pass by said seal and into said piston chamber, and so that said slurry fuel located in said piston chamber is prevented from passing by said seal and into said clearance gap.

* * * * *